United States Patent [19]

Gardner

[11] 4,148,428

[45] Apr. 10, 1979

[54] CONVERTIBLE PARTITION ARRANGEMENT

[75] Inventor: Jeffrey M. Gardner, Wheaton, Ill.

[73] Assignee: Container Corporation of America, Chicago, Ill.

[21] Appl. No.: 883,056

[22] Filed: Mar. 3, 1978

[51] Int. Cl.[2] ..... B65D 5/48

[52] U.S. Cl. ..... 229/15; 229/42

[58] Field of Search ..... 229/15, 42, 27, 28

[56] References Cited

U.S. PATENT DOCUMENTS

| | | | |
|---|---|---|---|
| 2,919,815 | 1/1960 | Mairs et al. | 229/42 X |
| 2,925,209 | 2/1960 | Wasyluka | 229/15 |
| 3,738,561 | 6/1973 | Nederveld | 229/15 |
| 3,963,169 | 6/1976 | Gardner | 229/15 |
| 3,982,684 | 9/1976 | David | 229/15 |
| 4,030,660 | 6/1977 | Rada et al. | 229/15 |

*Primary Examiner*—Davis T. Moorhead

*Attorney, Agent, or Firm*—Carpenter & Ostis

[57] ABSTRACT

A paperboard partition arrangement which may be selectively used to form either four or eight cells within an external package.

3 Claims, 4 Drawing Figures

CONVERTIBLE PARTITION ARRANGEMENT

SUMMARY OF THE INVENTION

This invention relates to internal partitions of the type employed within outer shipping containers or other packages to provide separate internal cells.

The invention particularly relates to partitions formed of foldable sheet material, such as paperboard, which may be readily erected for use or collapsed for shipping to the ultimate user.

It is an object of the invention to provide, in an internal partition structure, an arrangement which contains both transverse and longitudinal members interconnected in such a manner as to provide a plurality of separate cells therebetween.

A more specific object of the invention is the provision, in a partition of the type described, of an arrangement which lends itself to easily being converted from a four cell divider to an eight cell divider by the insertion of an additional partition member.

These and other objects of the invention will be apparent from an examination of the following description and drawings.

THE DRAWINGS

It will be understood that, for purposes of clarity, certain elements may have intentionally omitted from certain views where they are believed to be illustrated to better advantage in other views.

THE DESCRIPTION

Figure 3:
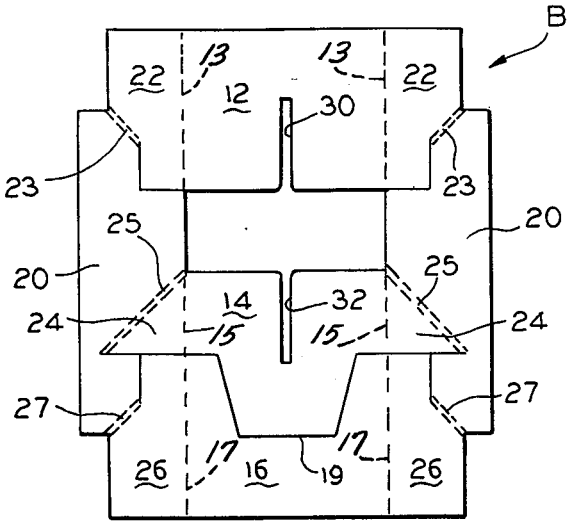
FIG. 3 is a plan view of the blank from which the structure illustrated in FIG. 2 may be formed.
Figure 2:
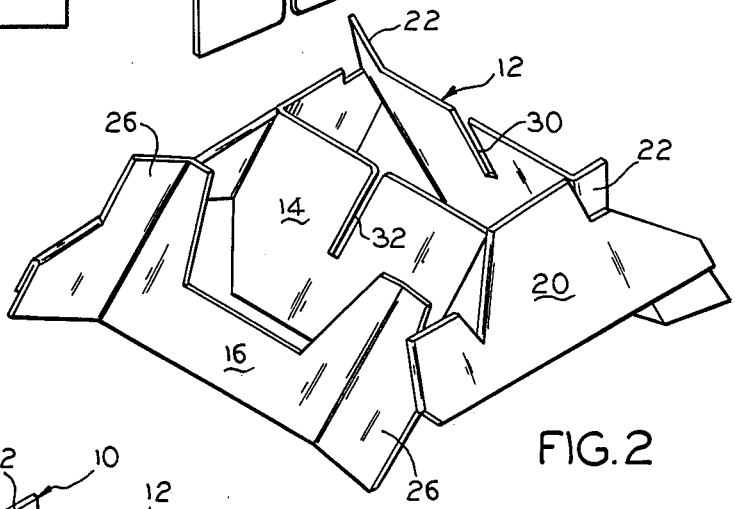
FIG. 2 is a view similar to FIG. 1 but showing the structure in a partially erected condition.
Figure 1:
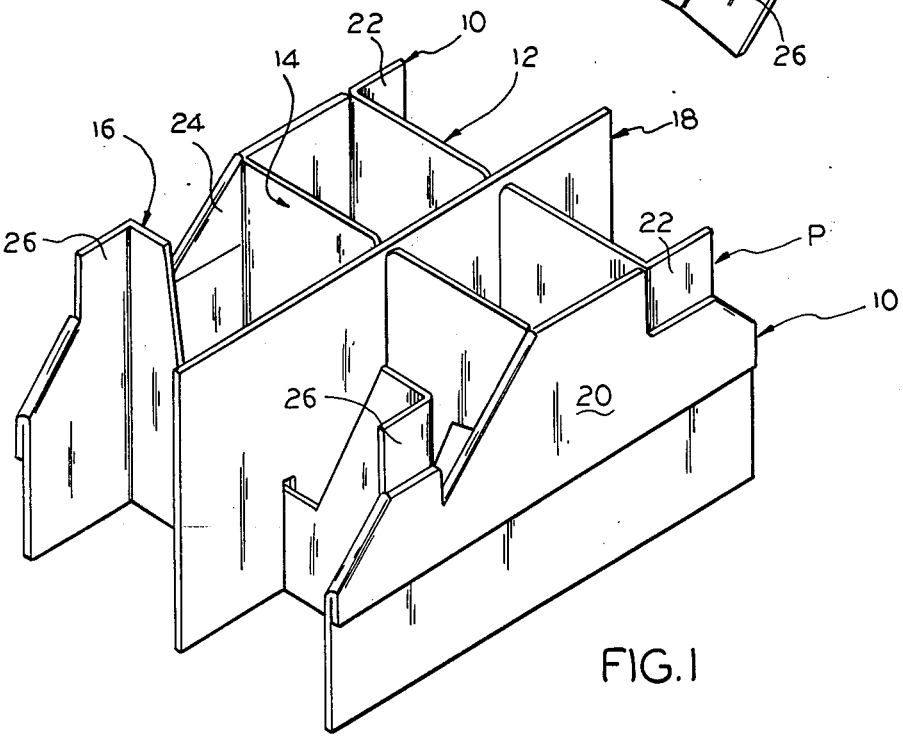
FIG. 1 is a perspective view of a partition structure embodying features of the invention.

Referring now to the drawings for a better understanding of the invention, and particularly to FIGS. 1 and 2, it will be seen that a basic partition structure indicated generally at P, may be formed from a unitary blank B of foldable paperboard as illustrated in FIG. 3.

Basically, partition P includes a pair of vertically disposed transverse members 10 which are spaced from each other in parallel relation and which are interconnected, intermediate their respective ends, by a plurality of integral, vertically disposed first, second and third longitudinal members 12, 14 and 16, respectively.

Each of the longitudinal members comprises a single panel with the first and second longitudinal members 12 and 14 presenting in their upper edges thereof vertical slots 30 and 32, respectively, the purpose of which is hereinafter described.

It will be noted that the partition P is formed from a compact blank B of paperboard which utilizes a minimum amount of material and has a minimum amount of waste or trim when cut from larger sheets of paperboard, because of its efficient design. It will be noted that all of the longitudinal panels are not full depth and that longitudinal panels 14 and 16 are spaced from each other by a cut line 19, as best seen in FIG. 3.

Each of the transverse members 10 includes an irregularly shaped outer panel 20, which is higher in the center than at the sides, and a plurality of first, second and third inner panels 22, 24 and 26, respectively.

Each set of inner panels 22, 24 and 26 are foldably joined along certain edges to adjacent vertical end edges of first and second and third longitudinal members along fold lines 13, 15, and 17, respectively, and have other edges joined to upper edges of the related outer panel 20 along diagonal or sloping fold lines 23, 25, and 27, respectively.

Each of the inner panels is folded so as to lie in face-to-face relation with a portion of the inner surface of related outer panel 20.

Thus, it will be seen that when the partition structure is in erected condition, it provides four cells within an outer package.

Figure 4:
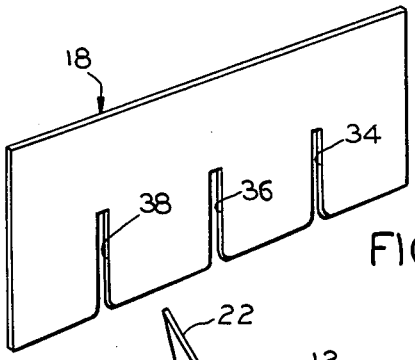
FIG. 4 is a perspective view of the supplementary partition illustrated in FIG. 1.

It will also be understood that the structure is arranged to be converted to an eight cell divider by the insertion of a supplemental or additional transverse partition member 18, illustrated in FIG. 4, which is provided at its lower edge with a plurality of vertical slots 34, 36 and 38, adapted to receive upper portions of first, second and third longitudinal members, respectively, as illustrated in FIG. 1.

I claim:

1. In a convertible partition, formed of foldable sheet material such as paperboard, for forming a plurality of cells within an outer package, the combination of:

(a) a pair of vertically disposed, transverse members spaced from each other in parallel relation at opposite ends of said partition;

(b) first, second, and third vertically disposed, longitudinal members extending between said transverse members and normal thereto, and spaced from each other in parallel relation;

(c) each of said longitudinal members comprising a single panel;

(d) each of said transverse members including:

(i) an outer panel;

(ii) first, second, and third inner panels;

(e) said first, second, and third inner panels:

(i) being co-planar with, but spaced from each other;

(ii) having certain edges foldably joined along vertical fold lines to adjacent end edges of said first, second, and third longitudinal members, respectively;

(iii) having other edges foldably joined along diagonally extending fold lines to upper edges of a related outer panel;

(iv) being folded in face-to-face relation with said related outer panel.

2. A partition according to claim 1, and including:

(a) means presented by certain of said longitudinal members for receiving an additional transverse member;

(b) an additional transverse member positioned between said pair of transverse members in parallel relation therewith, and having interlocking engagement with certain of said longitudinal members.

3. A partition according to claim 2, wherein said additional transverse member and certain of said longitudinal members have slots formed therein for mutual connection with each other.

* * * * *